US005509452A

United States Patent [19]

Tammera

[11] Patent Number: 5,509,452

[45] Date of Patent: Apr. 23, 1996

[54] VAPOR CONTROLLED FUEL DISPENSING NOZZLE ATTACHMENT

[75] Inventor: Robert F. Tammera, West Orange, N.J.

[73] Assignee: Exxon Research and Engineering Company, Florham Park, N.J.

[21] Appl. No.: 289,724

[22] Filed: Aug. 12, 1994

[51] Int. Cl.[6] ..... B67D 5/32

[52] U.S. Cl. ..... 141/207; 141/392

[58] Field of Search ..... 141/59, 206–211, 141/290, 302, 392

[56] References Cited

U.S. PATENT DOCUMENTS

| | | | |
|---|---|---|---|
| 3,815,327 | 6/1974 | Viland | 141/290 X |
| 3,982,571 | 9/1976 | Fenton et al. | 141/207 X |
| 4,003,415 | 1/1977 | Lasater | 141/59 |
| 4,697,624 | 10/1987 | Bower et al. | 141/208 |
| 5,085,258 | 2/1992 | Fink, Jr. et al. | 141/207 |
| 5,121,777 | 6/1992 | Leininger et al. | 141/207 |

*Primary Examiner*—J. Casimer Jacyna
*Attorney, Agent, or Firm*—Ronald D. Hantman

[57] ABSTRACT

An improved vapor recovery system for a fuel dispensing nozzle having an automatic shut-off. The improvement includes a lockout for activating the automatic shut-off, an activating collar having one end adjacent to the lock-out and able to engage the lock-out when the nozzle is dispensing fuel, and a seal enclosing the lock-out and the collar, the seal having (i) a cup-shaped portion at end that fits over and circumferentially around the fuel inlet while the nozzle is dispensing fuel, (ii) a middle portion that compresses while the nozzle is dispensing fuel, and (iii) an interior constriction that engages the end of the collar opposite of the lock-out so as to prevent back splashed fuel from entering the portion of the seal enclosing the collar.

6 Claims, 1 Drawing Sheet

VAPOR CONTROLLED FUEL DISPENSING NOZZLE ATTACHMENT

FIELD OF THE INVENTION

The present invention relates to an improved means of utilizing a vapor recovery system when dispensing fuel into a vehicle, using a fuel dispensing nozzle.

Vapor recovery systems on fuel dispensing nozzles are required by EPA law in most states. The current vapor nozzles, referred to as Stage II nozzles, include a flexible hose with bellows having a rubber disc shaped end which forms a face seal by abutting the outer rim of the vehicle fuel tank filler neck. In some cases, such seals may tend to leak vapor fumes into the atmosphere. In addition, splash-back fuel may get caught in the convolutions of the bellows. The accumulated fuel may, inevitably be dribbled to the ground.

SUMMARY OF THE INVENTION

The present invention is an improvement for vapor recovery systems using Stage II fuel nozzles. The vapor recovery system is part of fuel nozzles having an automatic shut-off mechanism. The automatic shut-off mechanism is activated by a lockout when the nozzle is dispensing fuel. When the tank level is met, the shut-off mechanism terminates fuel dispensing. An activating collar, which is adjacent to the nozzle lockout, engages the lockout when the nozzle is dispensing fuel which in turn engages the automatic shut-off mechanism. A seal encloses the lock-out and collar. The seal has a cup-shaped portion at one end that fits over and circumferentially around the fuel inlet while the nozzle is dispensing fuel, a middle portion that compresses while the nozzle is dispensing fuel, and an interior constriction that engages the one end of the collar so as to prevent back-splashed fuel from entering the portion of the seal enclosing the collar.

DESCRIPTION OF THE PREFERRED EMBODIMENT

Figure 1:
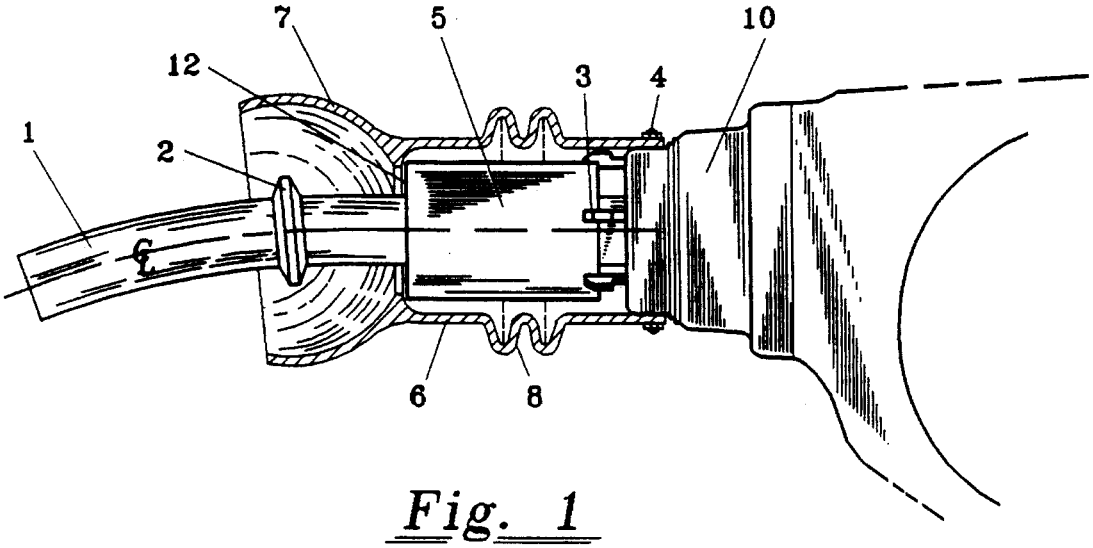
FIG. 1 shows a cross-section through the vapor-recovery portion and fuel discharge pipe of the present invention.

FIG. 1 illustrates a fuel dispensing nozzle which includes the improvements of the present invention. The nozzle (10) may be any conventional vapor recovery type nozzle with nozzle discharge tube (1) and lock-out (3). One type of lock-out is a collar which encircles the discharge tube and has splines which move into the nozzle housing (10) to engage the automatic shut-off system. The lock-out (3) is adjacent to the activating collar (5) which may be fixed to the lock-out (3). The activating collar (5) encircles the discharge tube (1). A radial vapor gap is (11) maintained between the discharge tube (1) and the activating collar (5) to allow the fuel vapors from the fuel tank to be recovered.

The fuel vapor passes through the vapor gap (11) into the nozzle housing (10) using conventional vapor recovery technology known in the art.

Figure 2:
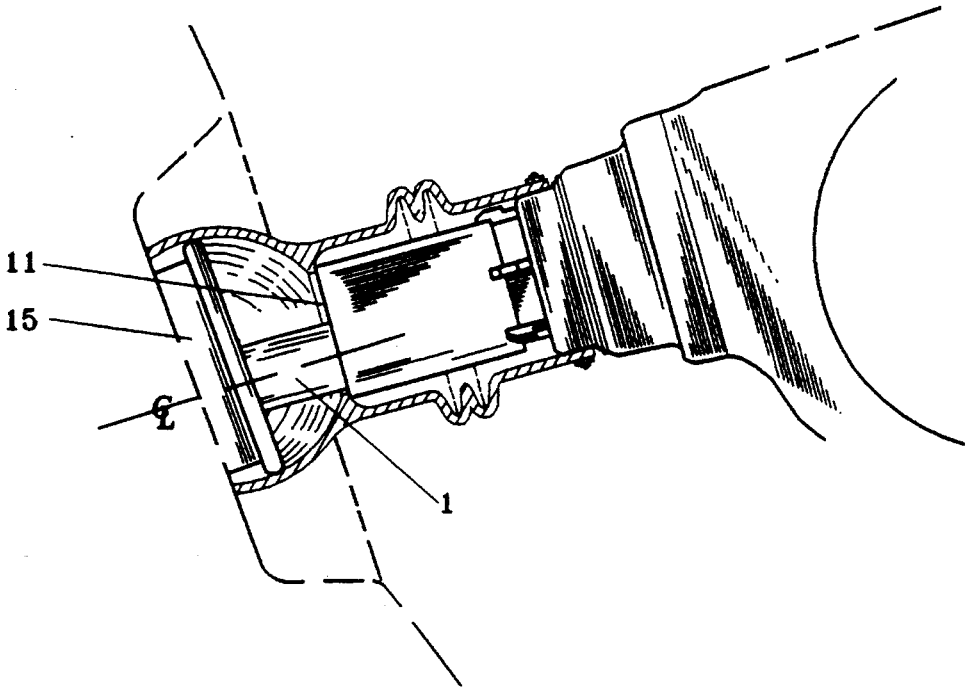
FIG. 2 shows a cross-section through the cup-shaped portion of the seal engaging a fuel inlet.

The activating collar (5) is enclosed by a seal (6) which is fixed to the nozzle housing (10) by a conventional hose clamp (4) or other means. The seal has two sections, a cup-shaped end portion (7) and a middle compressible section (8). The cup-shaped portion may be hemispherical in shape and fabricated out of an elastomeric material which is resistant to fuel. The cup-shaped portion (7) fits over and around the fuel inlet (15) when the nozzle is dispensing fuel (see FIG. 2). The shape of the flexible cup-shaped portion (7) self-adjusts over the fuel inlet (15) to prevent vapors from escaping into the atmosphere. The middle portion (8) compresses so that an interior constriction (12) presses against the activating collar (5) which prevents back splash fuel from entering the region between the activating collar (5) and the interior of the seal (6). The collar may be a solid cylinder. Such backsplash fuel gets caught within the area of the seal (6) and is later drained into the fuel inlet (15) when the nozzle terminates dispensing fuel.

What is claimed is:

1. An improvement on a fuel vapor recovery system for a fuel dispensing nozzle having an automatic shut-off for dispensing fuel into a fuel inlet, wherein said improvement comprises:

(a) a lock-out for activating said automatic shut-off (b) an activating collar having one end adjacent to said lock-out and able to engage said lock-out when said nozzle is dispensing fuel, and (c) a seal enclosing said lock-out and said collar, said seal having (i) a cup-shaped portion having a concave side at the end that fits over and circumferentially around said fuel inlet while said nozzle is dispensing fuel so that said concave side of said cup is in sealing engagement with said fuel inlet, (ii) a middle portion that compresses while said nozzle is dispensing fuel, and (iii) an interior constriction that engages the end of said collar opposite of said lock-out so as to prevent back splashed fuel from entering the region between the activating collar and the interior of the seal.

2. The fuel vapor recovery system of claim 1 wherein:

(a) said cup-shaped portion of said seal self adjusts to various fuel inlets of each vehicle by utilizing the shape of the inner cup contour thereby preventing vapors from escaping to the atmosphere.

3. The fuel vapor recovery system of claim 2 wherein said seal is fabricated from a resilient but flexible material, having the ability to tightly seal the said fuel inlet.

4. The fuel vapor recovery system of claim 3 wherein said seal is fabricated from elastomeric material.

5. The fuel vapor recovery system of claim 1 wherein said cup-shaped portion is hemispherical in shape.

6. The fuel vapor recovery system of claim 1 wherein said elastomeric material is similar to the elastic properties of natural rubber.

* * * * *